US005656406A

United States Patent [19]

Ikuno et al.

[11] Patent Number: 5,656,406

[45] Date of Patent: Aug. 12, 1997

[54] ELECTROPHOTOGRAPHIC PHOTOCONDUCTOR WITH AMORPHOUS CARBON OVERLAYER

[75] Inventors: Hiroshi Ikuno; Narihito Kojima; Hiroshi Nagame, all of Numazu; Shunpei Yamazaki; Shigenori Hayashi, both of Atsugi, all of Japan

[73] Assignees: Ricoh Company, Ltd., Tokyo; Semiconductor Energy Laboratory Co., Ltd., Atsugi, both of Japan

[21] Appl. No.: 371,384

[22] Filed: Jan. 11, 1995

[30] Foreign Application Priority Data

Jan. 11, 1994 [JP] Japan ..... 6-013201
Nov. 11, 1994 [JP] Japan ..... 6-303090

[51] Int. Cl.[6] ..... G03G 5/147

[52] U.S. Cl. ..... 430/67; 430/66

[58] Field of Search ..... 430/66, 67

[56] References Cited

U.S. PATENT DOCUMENTS 4,675,265 6/1987 Kazama et al. ..... 430/67
4,891,292 1/1990 Masaki et al. ..... 430/66
4,932,859 6/1990 Yagi et al. ..... 430/66
4,965,156 10/1990 Hotomi et al. ..... 430/66
5,268,247 12/1993 Hayashi ..... 430/67

FOREIGN PATENT DOCUMENTS 227160 9/1989 Japan ..... 430/67

*Primary Examiner*—Roland Martin
*Attorney, Agent, or Firm*—Oblon, Spivak, McClelland, Maier & Neustadt, P.C.

[57] ABSTRACT

An electrophotographic photoconductor includes an electroconductive support; a photoconductive layer formed on the electroconductive support; and a surface protective layer formed on the photoconductive layer, the surface protective layer having a hydrogen-containing diamond-like carbon structure or amorphous carbon structure, which contains at least one additive element selected from the group consisting of nitrogen, fluorine, boron, phosphorus, chlorine, bromine and iodine, with the atomic ratio of the additive element to the carbon in the carbon structure having such a distribution in the direction of the thickness of the surface protective layer that the atomic ratio is smaller in the vicinity of the top surface of the surface protective layer and in the vicinity of the photoconductive layer adjacent to the surface protective layer than in the other portion of the surface protective layer.

2 Claims, 3 Drawing Sheets

ELECTROPHOTOGRAPHIC PHOTOCONDUCTOR WITH AMORPHOUS CARBON OVERLAYER

BACKGROUND OF THE INVENTION

1. Field of the Invention

The present invention relates to an electrophotographic photoconductor, more particularly to an electrophotographic photoconductor comprising a photoconductive layer and a surface protective layer formed thereon for protecting the photoconductive layer, which surface protective layer has excellent anti-peeling performance and is capable of maintaining electrophotographic characteristics of the photoconductor even when used repeatedly for an extended period of time.

2. Discussion of Background

Conventionally, as photoconductors for use in electrophotography, there are generally known a photoconductor comprising an electroconductive support and a photoconductive layer formed thereon, which photoconductive layer comprises selenium or a selenium alloy as a main component; a photoconductor comprising a photoconductive layer, which comprises an inorganic photoconductive material such as zinc oxide or cadmium sulfide and a binder agent in which such an inorganic photoconductive material is dispersed; a photoconductor comprising a photoconductive layer, which comprises organic materials such as poly-N-vinylcarbazole and trinitrofluorenone or an azo pigment in combination; and a photoconductor comprising a photoconductive layer, which comprises an amorphous silicon-based material.

Generally, "electrophotography" is an image formation process. In electrophotography, the surface of a photoconductor is uniformly charged in the dark to a predetermined polarity, for instance, by corona charging. The uniformly charged surface of the photoconductor is then exposed to light images to selectively dissipate electric charges from the areas of the photoconductor exposed to the light images, so that latent electrostatic images are formed on the surface of the photoconductor. The thus formed latent electrostatic images are developed into visible images by a developer comprising a coloring agent such as a dye or pigment, and a binder agent such as a polymeric material.

The photoconductor for use in such an electrophotographic process As required to have the following fundamental characteristics: (1) chargeability to an appropriate potential in the dark, (2) minimum dissipation of electrical charge in the dark, and (3) rapid dissipation of electrical charges from the areas exposed to light.

Recently, however, in accordance with the recent development of high speed and large size electrophotographic copying machines, in addition to the above-mentioned fundamental characteristics, there is demanded for a photoconductor with high reliability with respect to the capability of forming images with high quality even if the photoconductor is used repeatedly for an extended period of time.

Causes for shortening the life of photoconductors for use in electrophotographic copying machines can be classified into the following two causes:

One cause is the photoconductor being frictioned, or scratches being formed on the surface of the photoconductor by the mechanical stress applied to the photoconductor whale in use, in particular, in the course of a development process, a cleaning process or a copy paper transportation process.

The other cause is the photoconductor being chemically damaged, which is caused by corona charging in the course of a charging process, an image transfer process end a transfer sheet separation process.

As a technique of preventing the photoconductor from being frictioned, a method of providing a protective layer on the surface of the photoconductor is known. Specific examples of such a method include a method of providing an organic film on the surface of a photoconductor as disclosed in Japanese Patent Publication 38-15466; a method of coating the surface of a photoconductor with an inorganic oxide as disclosed in Japanese Patent Publication 43-14517; a method of providing an insulating layer on the surface of a photoconductor with an adhesive layer being interposed therebetween as disclosed in Japanese Patent Publication 43-27591; and methods of providing a-Si later a-S:N:H layer, a-Si:O:H layer or the like on the surface of a photoconductor by a plasma CVD method, a photo CVD method or the like as disclosed in Japanese Laid-Open Patent Applications 57-179859 and 59-58437.

Furthermore, recently films with high hardness consisting of carbon, or comprising carbon as a main component, which are referred to as, for instance, a-C:H film, an amorphous carbon film or non-crystalline carbon film, or a diamond-like carbon film are produced by the plasma CVD method, the photo CVD method, a sputtering method, or the like, and the utilization of such films as a protective layer for a photoconductor has been actively proposed. For instance, Japanese Laid-Open Patent Application 60-249155 discloses the provision of a protective layer comprising amorphous carbon or carbon with high hardness on the surface of a photoconductive layer; Japanese Laid-Open Patent Application 61-255352 discloses the provision of a protective layer comprising a diamond-like carbon on the top surface of a photoconductive layer; Japanese Laid-Open Patent Application 61-264355 discloses the provision of an insulating layer with high hardness comprising carbon as a main component on a photoconductive layer; and Japanese Laid-Open Patent Applications 63-220166, 63-220167, 63-220168 and 63-220169 disclose protective layers, each of which comprises a noncrystalline hydrocarbon film, which contains at least one element selected from the group consisting of a nitrogen atom, a hydrogen atom, a halogen atom, an alkali metal atom, and the like, and is formed by glow discharge.

These methods provide photoconductors with significantly improved surface hardness and excellent abrasion resistance. However, the thus obtained photoconductors do not have sufficient resistance against the peeling of the protective layers away from the surface of the photoconductors, which is caused by the mechanical stress applied locally to the protective layers while in use for an extended period of time and/or by some materials produced by corona charging.

In order to eliminate the above shortcomings, and to improve the durability and humidity resistance of an electrophotographic photoconductor, thereby preventing the fogging of produced images, there has been proposed in Japanese Laid-Open Patent Application 1-22716 a photoconductor comprising a photoconductive layer on which there is overlaid an amorphous hydrocarbon film containing fluorine therein, serving as a surface protective layer, in which the concentration of the fluorine is increased in the direction of the thickness of the surface protective layer towards the photoconductive layer. However, the peeling resistance of the protective layer of this photoconductor is still insufficient for use in practice.

SUMMARY OF THE INVENTION

It is therefore an object of the present invention to provide an electrophotographic photoconductor comprising a photoconductive layer and a surface protective later comprising carbon as a main component formed thereon, which is improved with respect to the peeling resistance of the surface protective layer and is capable of forming images in a stable manner for an extended period of time even when used repeatedly.

This object of the present invention can be achieved by an electrophotographic photoconductor which comprises an electroconductive support; a photoconductive layer formed on the electroconductive support; and a surface protective layer formed on the photoconductive layer, the surface protective layer having a hydrogen-containing diamond-like carbon structure or amorphous carbon structure, which comprises at least one additive element selected from the group consisting of nitrogen, fluorine, boron, phosphorus, chlorine, bromine and iodine, with the atomic ratio of the additive element to the carbon in the carbon structure having such a distribution in the direction of the thickness of the surface protective layer that the atomic ratio is smaller in the vicinity of the top surface of the surface protective layer and in the vicinity of the photoconductive layer adjacent to the surface protective layer than in the other portion of the surface protective layer.

Alternatively, the above-mentioned object of the present invention can be achieved by an electrophotographic photoconductor which comprises an electroconductive supports a photoconductive layer formed on the electroconductive support; end a surface protective layer formed on the photoconductive layer, the surface protective layer having a hydrogen-containing diamond-like carbon structure or amorphous carbon structure, which comprises nitrogen with the atomic ratio thereof to the carbon, that is, the N/C ratio, in the carbon structure having such a distribution in the direction of the thickness of the surface protective layer that the atomic ratio is 0.005 or less in the vicinity of the top surface of the surface protective layer and in the vicinity of the photoconduc-tive layer adjacent to the surface protective layer, and 0.05 or more in the other portion of the surface protective layer.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
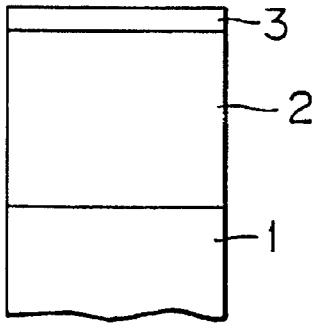
FIGS. 1 to 4 are partial, schematic cross-sectional views of examples of an electrophotographic photoconductor according to the present invention.

An electrophotographic photoconductor of the present invention comprises an electroconductive support; a photoconductive layer formed on the electroconductive support; and a surface protective layer formed on the photoconductive layer, the surface protective layer having a hydrogen-containing diamond-like carbon structure or amorphous carbon structure, which comprises at least one additive element selected from the group consisting of nitrogen, fluorine, boron, phosphorus, chlorine, bromine and iodine, with the atomic ratio of the additive element to the carbon in the carbon structure having such a distribution in the direction of the thickness of the surface protective layer that the atomic ratio is smaller in the vicinity of the top surface of the surface protective layer and in the vicinity of the photoconductive layer adjacent to the surface protective layer than in the other portion of the surface protective layer.

By the above-mentioned structure of the photoconductor, the peeling resistance of the surface protective layer is significantly improved, and images can be formed in a stable manner for an extended period of time.

To be more specific, by the addition of at least one additive element selected from the group consisting of nitrogen, fluorine, boron, phosphorus, chlorine, bromine and iodine to the surface protective layer having a hydrogen-containing diamond-like carbon structure or amorphous carbon structure, the electric characteristics of the photoconductor including the chargeability thereof are significantly improved, and a surface protective layer with highly increased transparency and hardness can be provided.

Furthermore, as the atomic ratio of the additive element to the carbon in the carbon structure is decreased, the film formation performance and the adhesion of the surface protective layer to the photoconductive layer are improved, so that it is preferable that the atomic ratio of the additive element to the carbon in the carbon structure have such a distribution in the direction of the thickness of the surface protective layer that the atomic ratio is smaller in the vicinity of the top surface of the surface protective layer and in the vicinity of the photoconductive layer adjacent to the surface protective layer than in the other portion of the surface protective layer.

When the adhesiveness of the surface protective layer to the photoconductive layer is increased, the surface protective layer is capable of preventing materials produced by corona charging, for example, gases such as $NO_x$ and $O_3$, and ions such as nitric acid ion, sulfuric acid ion, and nitronium ion, from penetrating into the photoconductive layer.

Therefore, when providing the surface protective layer on the photoconductive layer, for example, a first surface protective layer which is free from any of the above-mentioned additive elements or which contains a small amount of the additive element, is first provided in the vicinity of or on the photoconductive layer to obtain a sufficient adhesion between the surface protective layer and the photoconductive layer, and then a second surface protective layer containing a relatively large amount of the additive element is overlaid on the first surface protective layer, whereby it is possible to protect the photoconductive layer from being damaged by an etching gas such as $N_2$, $NH_3$, $C_2F_6$, $NF_3$, $B_2H_6$, $BCl_3$, BBr, $BF_3$, $PH_3$, $PF_3$ or $PCl_3$, which is employed when the second surface protective layer containing a relatively large amount of the additive element is formed.

Thereafter, a third surface protective layer which is free from any of the above-mentioned additive elements or which contains a small amount of the additive element, is provided on the second surface protective layer, whereby it is possible to prevent materials which are actually produced by corona charging in a copying machine, for example, gases such as $NO_x$ and $O_3$, and ions such as nitric acid ion, sulfuric acid ion, and nitronium ion, from penetrating into the photoconductive layer.

FIG. 1 is a partial, schematic cross-sectional view of an example of an electrophotographic photoconductor of the present invention.

The electrophotographic photoconductor shown in FIG. 1 comprises an electroconductive support 1, a photoconductive layer 2 provided on the electroconductive support 1, and a surface protective layer 3 provided on the photoconductive layer 2.

Figure 2:
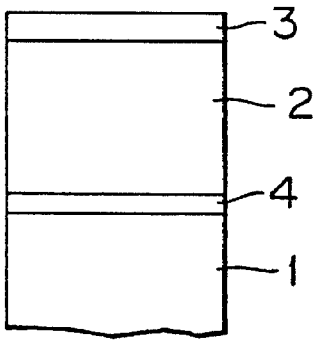
Figure 3:
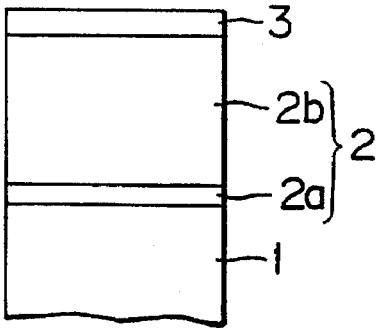
Figure 4:
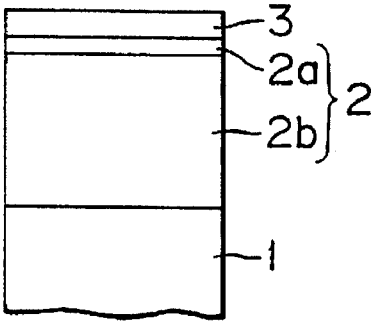

FIGS. 2 to 4 are partial, schematic cross-sectional views of other examples of an electrophotographic photoconductor of the present invention.

The electrophotographic photoconductor shown in FIG. 2 comprises an electroconductive support 1, an undercoat layer 4 provided on the electroconductive support 1, a photoconductive layer 2 provided on the undercoat layer 4, and a surface protective layer 3 provided on the photoconductive layer 2.

The electrophotographic photoconductor shown in FIG. 3 As of the same layered structure as that of the electrophotographic photoconductor shown in FIG. 1, provided that the photoconductive layer 2 is composed of a charge generation layer 2*a* and a charge transport layer 2*b* which is overlaid on the charge generation layer 2*a*. This photoconductive layer 2 is referred to as a function-separated type photoconductive layer.

The electrophotographic photoconductor shown in FIG. 4 is of the same layered structure as that of the electrophotographic photoconductor shown in FIG. 3, provided that the overlaying order of the charge generation layer 2*a* and the charge transport layer 2*b* is reversed in the function-separated type photoconductive layer 2.

The layered structure of the electrophotographic photoconductor of the present invention is not limited to the above layered structures, but can be modified in any manner as long as at least the photoconductive layer 2 is provided on the electroconductive support 1, and the photoconductive layer 2 is protected by the surface protective 3.

As the material for the electroconductive support 1 for use in the present invention, there can be employed conductive materials, and insulating materials which are treated so as to be conductive, such as Al, Fe, Cu, Au and alloys thereof, and insulating substrates such as polyester, poly-carbonate, polyimide and glass, which are provided with a conductive film thereon, which is made of a metal such as Al, Ag or Au, a conductive material such as $In_2O_3$ or $SnO_2$, or paper treated so as to be electroconductive.

There is no particular limitation to the shape of an electroconductive support, so that the electroconductive support may be plate-shaped, drum-shaped or belt-shaped.

The undercoat layer which is provided between the electroconductive support and the photoconductive layer is for the improvement of the electrophotographic characteristics of the electrophotographic photoconductor and the adhesion of the photoconductive layer to the electroconductive support.

As the material for the undercoat layer, there can be employed inorganic materials such as SiO, $Al_2O_3$, a silane coupling agent, a titanium coupling agent, and a chromium coupling agent; and binder agents with excellent adhesiveness such as polyamide resin, alcohol-soluble polyamide resin, water-soluble polyvinyl butyral, polyvinyl butyral. In addition, composite materials comprising any of the above-mentioned binder agents with excellent adhesiveness and a material such as ZnO, $TiO_2$, or ZnS, which is dispersed in the binder agent, can be employed as the material for the undercoat layer.

The undercoat layer made of any of the above-mentioned inorganic materials can be formed by sputtering or vacuum deposition. When the undercoat layer is made of any of the above-mentioned organic materials, the undercoat layer can be provided by a conventional coating method.

It is preferable that the undercoat layer have a thickness of 5 μm or less.

As the photoconductive layer which is directly provided on the above-mentioned electroconductive support or with the undercoat layer being interposed between the photoconductive layer and the electroconductive layer, a Se-based photoconductive layer and an organic photoconductive layer may be both employed. Furthermore, with respect to the structure of the photoconductive layer, a single-layer type photoconductive layer and a function-separated type photoconductive layer may be both employed.

Examples of a single-layer organic photoconductive layer include (1) a coated layer comprising a photoconductive powder of dye-sensitized zinc oxide, titanium oxide, or zinc sulfate; an amorphous silicon powder; a squarylic salt pigment; a phthalocyanine pigment; an azuleninium salt pigment; or an azo pigment; and if necessary, a binder agent and/or an electron-donating compound which will be described in detail, and (2) a layer of a composition comprising a eutectic complex of a pyrylium based dye and a bisphenol A based polycarbonate, and an electron-donating compound.

As the binder resin for use in the above-mentioned single-layer organic photoconductive layer, the same binder resins as those employed in a function-separated type photoconductive layer (which will be described later) can be employed.

It is preferable that the single-layer type photoconductive layer be in the range of 5 to 30 μm.

An example of the function-separated type photoconductive layer comprises a charge generation layer and a charge transport layer which are overlaid.

The charge generation layer (CGL) may be a layer comprising inorganic photoconductive powder of crystalline selenium or arsenic selenide; or an organic dye or pigment and a binder resin in which the organic dye or pigment is dispersed or dissolved.

Examples of such an organic dye or pigment serving as a charge generating material are as follows: C.I. Pigment Blue 25 (C.I. 21180), C.I. Pigment Red 41 (C.I. 21200), C.I. Acid Red 52 (C.I. 45100), C.I. Basic Red 3 (C.I. 45210); phthalocyanine pigments having a polyfine skeleton, azulenium salt pigment, squarylic salt pigment, azo pigments having a carbazole skeleton (Japanese Laid-Open Patent Application 53-95033), azo pigments having a styryl stilbene skeleton (Japanese Laid-Open Patent Application 53-138229), azo pigments having a triphenylamine skeleton (Japanese Laid-Open Patent Application 53-132547), azo pigments having a dibenzothiophene skeleton (Japanese Laid-Open Patent Application 54-21728), azo pigments having an oxadiazole skeleton (Japanese Laid-Open Patent Application 54-12742), azo pigments having a fluorenone skeleton (Japanese Laid-Open Patent Application 54-22834), azo pigments having a bisstilbene skeleton (Japanese Laid-Open Patent Application 54-17733), azo pigments having a distyryl oxadiazole skeleton (Japanese Laid-Open Patent Application 54-2129), azo pigments having a distyryl carbazole skeleton (Japanese Laid-Open Patent Application 54-17734), and azo pigments having a carbazole skeleton (Japanese Laid-Open Patent Applications 57-195767 and 57-195768); phthalocyanine pigments such as C.I. Pigment Blue 16 (C.I. 74100); indigo pigments such as C.I. Vat Brown 5 (C.I. 73410) and C.I. Vat Dye (C.I. 73030); and perylene pigments such as Algol Scarlet B (made by Violet Co., Ltd.) and Indanthrene Scarlet R (made by Bayer Co., Ltd.). These charge generating materials may be used alone or in combination.

Examples of a binder resin which is used in combination with the above-mentioned organic dyes or pigments are adhesive and insulating resins, specifically, condensation resins such as polyamide, polyurethane, polyester, epoxy resin, polycarbonate, polyether; and polymers and copolymers such as polystyrene, polyacrylate, polymethacrylate, poly-N-vinylcarbazole, polyvinyl butyral, styrene-butadiene copolymer and styrene-acrylonitrile copolymer.

It is preferable that such a binder resin be employed in an amount of 0 to 100 parts by weight, more preferably in an amount of 0 to 50 parts by weight, to 100 parts by weight of the charge generating material.

The charge generation layer can be formed by dispersing a charge generating material, if necessary, together with a binder resin, in a solvent such as tetrahydrofuran, cyclohexanone, dioxane or dichloroethane, by use of a ball mill, an attritor, or a sand mill, to prepare a coating liquid for the formation of the charge generation layer, diluting the coating liquid appropriately, and coating the liquid. This coating can be carried out by immersion coating, spray coating or bead coating.

It is preferable that the charge generation layer have a thickness in the range of about 0.01 to 5 μm, more preferably in the range of 0.1 to 2 μm.

In the present invention, when crystalline selenium or arsenic selenide is used as the charge generating material, the crystalline selenium or arsenic selenide is used in combination with an electron-donating adhesive agent and/or an electron-donating organic compound.

Examples of such an electron-donating material are polycarbazole; derivatives thereof, for example, polycarbazoles with a substituent such as a halogen such as chlorine and bromine, methyl group, or amino group; polyvinyl pyrene; oxadiazole; pyrazoline, hydrazone; diarylmethane; α-phenylstilbene; nitrogen-containing compounds such as triphenylamine compounds and derivatives thereof; end diarylmethane compounds.

Of these compounds, polyvinylcarbazole and derivatives thereof are particularly preferable. These compounds can be employed in combination, but in this case, it is preferable to add other electron-donating compounds to polyvinylcarbazole and derivatives thereof.

It is preferable that such inorganic charge generating materials be contained in the charge generation layer in an amount of 30 to 90 wt. % of the entire weight of the charge generation layer.

Furthermore, it is preferable that the charge generation layer comprising such an inorganic charge generating material have a thickness in the range of about 0.2 to 5 μm.

The charge transport layer has the functions of retaining electric charges, transporting the electric charges generated in the charge generation layer by being exposed to light images, and combining the retained electric charges with the electric charges generated in the charge generation layer.

It is required that the charge transport layer have (a) high electric resistivity for retaining electric charges, and (b) a small dielectric constant and excellent charge mobility for obtaining high surface potential by the retained electric charges.

In order to meet these requirements, the charge transport layer is composed of a charge transporting material and, if necessary, a binder resin. The charge transport layer can be formed by dissolving or dispersing the above-mentioned components in an appropriate solvent to prepare coating liquid for the formation of the charge transport layer, coating the coating liquid, and drying the coated liquid.

As the charge transporting material, there are a positive-hole transporting material and an electron transporting material.

Specific examples of the positive-hole transporting material are electron-donating materials such as poly-N-vinylcarbazole and derivatives thereof; poly-γ-carbazolyl ethyl glutamate and derivatives thereof; pyrene-formaldehyde condensate and derivatives thereof; polyvinyl pyrene; polyvinyl phenanthrene; oxazole derivatives; oxadiazole derivatives; imidazole derivatives; triphenylamine derivatives; 9-(p-diethylaminostyryl)-anthracene; 1,1-bis-(4-dibenzyl-aminophenyl)propane; styryl anthracene; styryl pyrazoline; phenylhydrazone; and α-phenylstilbene derivatives.

Specific examples of the electron transporting material are electron accepting materials such as chloroanil, bromanil, tetracyanoethylene, tetracyanoquinone dimethane, 2,4,7-trinitro-9-fluorenone, 2,4,5,7-tetranitro-9-fluorene, 2,4,5,7-tetranitroxanthone, 2,4,8-trinitrothioxanthone, 2,6,8-trinitro-4H-indeno(1,2-b)thiophenone-4-on, and 1,3,7-trinitrodibenzothiophenene-5,5-dioxide.

The above-mentioned charge transporting materials can be used alone or in combination.

Examples of a binder resin which is employed in the charge transport layer, when necessary; are thermoplastic resins and thermosetting resins, such as polystyrene, styrene-acrylonitrile copolymer, styrene-butadiene copolymer, styrene-maleic anhydride copolymer, polyester, polyvinyl chloride, vinyl chloride-vinyl acetate copolymer, polyvinyl acetate, polyvinylidene chloride, polyacrylate resin, phenoxy resin, polycarbonate, cellulose acetate resin, ethyl cellulose resin, polyvinyl butyral, polyvinyl formal, polyvinyl toluene, poly-N-vinylcarbazole, acrylic resin, silicone resin, epoxy resin, melamine resin, urethane resin, phenolic resin, and alkyd resin.

Examples of the solvent used when forming the charge transport layer include tetrahydrofuran, dioxane, toluene, monochlorobenzene, dichloroethane, and methylene chloride.

It Is preferable that the charge transport layer have a thickness of about 5 to 100 μm.

A plasticizer and a leveling agent may be added to the charge transport layer.

As the plasticizer for use in the charge transport layer, plasticizers in general use, such as dibutyl phthalate and dioctyl phthalate, can be employed as they are. It is preferable that such a plasticizer be employed in an amount of 0 to 30 parts by weight to 100 parts by weight of the binder resin.

As the leveling agent for use in the charge transport layer, silicone oils such as dimethyl silicone oil and methylphenyl silicone oil can be employed. It is preferable that such a leveling agent be employed in an amount of 0 to 1 part by weight to 100 parts by weight of the binder resin.

The charge generation layer and the charge transport layer may be overlaid on the electroconductive support in any order. In other words, the charge generation layer may be provided on the charge transport layer, or the charge transport layer may be provided on the charge generation layer.

It is preferable that the above-mentioned surface protective layer have C—C bonds having $SP^3$ orbits, which are similar to the C—C bonds of diamond. The carbon structure of the surface protective layer may be similar to the structure of graphite having $SP^2$ orbits. The carbon structure of the surface protective layer may also be an amorphous carbon structure.

The previously mentioned object of the present invention can also be achieved by an electrophotographic photoconductor which comprises an electroconductive support; a photoconductive layer formed on the electroconductive support; and a surface protective layer formed on the photoconductive layer, the surface protective layer having a hydrogen-containing diamond-like carbon structure or amorphous carbon structure, which comprises nitrogen with the atomic ratio thereof to the carbon, that is, the N/C ratio, in the carbon structure having such a distribution in the direction of the thickness of the surface protective layer that the atomic ratio is 0.005 or less in the vicinity of the top surface of the surface protective layer and in the vicinity of the photoconductive layer adjacent to the surface protective layer, and 0.05 or more in the other portion of the surface protective layer.

It is preferable that, in the surface protective layer, no additional elements be present in the vicinity of the top surface of the surface protective layer and also in the vicinity of the photoconductive layer adjacent to the surface protective layer, for better film formation of the top surface of the surface protective later and for better adhesion of the surface protective layer to the photoconductive layer.

It is preferable that the surface protective layer have a thickness of 5,000 Å to 50,000 Å.

Furthermore, the surface protective layer for use in the present invention may have a multi-layered structure, with the presence of the additive elements and the kinds thereof being controlled as mentioned so far.

An example of a surface protective layer with such a multi-layered structure comprises a first protective layer, a second protective layer a third protective layer, which are successively overlaid on the photoconductive layer in such a manner that the first protective layer is in contact with the photoconductive layer, the second protective layer is overlaid on the first protective layer, and the third protective layer is overlaid on the second protective layer, with the content of the additional element in the first protective layer and the third protective layer being made smaller than that of the additional element in the second protective layer in terms of the atomic ratio thereof to the carbon in the surface protective layer.

Such a multi-layered surface protective layer may be fabricated with further modification of the layered structure and the layer properties thereof.

A single solid layer surface protective layer, without any layer interfaces therein, may also be employed, in which the concentration gradient with respect to the atomic ratio of the additional element to the carbon in the hydrogen-containing diamond-like or amorphous carbon structure is set in such a manner that the atomic radio of the additional element is made smaller in the vicinity of the top surface of the surface protective layer and in the vicinity of the photoconductive layer adjacent to the surface protective layer than in the other portion of the surface protective layer.

As long as the conditions for the above-mentioned concentration gradient is satisfied, there is no particular limitation to the atomic ratio of the additional element to the carbon in the hydrogen-containing diamond-like or amorphous carbon structure.

The surface protective layer can be fabricated by use of a hydrocarbon gas such as methane, ethane, ethylene, acetylene or the like as the main material, and a carrier gas such as $H_2$, Ar or the like.

As the materials for supplying the additive elements, any materials that can be vaporized under reduced pressure or under application of heat thereto can be employed.

As the gases for supplying nitrogen, for example, $NH_3$ and $N_2$ can be employed; as the gases for supplying fluorine, for example, $C_2F_6$ and $CH_3F$ can be employed; as the gas for supplying boron, for example, $B_2H_6$ can be employed; as the gas for supplying phosphorus, for example, $PH_3$ can be employed; as the gases for supplying chlorine, for example, $CH_3Cl$, $CH_2Cl_2$, $CHCl_3$ and $CCl_4$ can be employed; as the gas for supplying bromine, for example, $CH_3Br$ can be employed; and as the gas for supplying iodine, for example, $CH_3I$ can be employed.

As the gases for supplying a plurality of additional elements, $NF_3$, $BCl_3$, BBr, $BF_3$, $PF_3$, $PCl_3$ and the like can be employed.

The surface protective layer can be fabricated by use of the above-mentioned gases, for example, by the plasma CVD method, the glow discharge decomposition method, the photo CVD method, or the sputtering method using graphite as a target.

The methods of fabricating the surface protective layer are not limited to the above-mentioned methods, but a film formation method disclosed in Japanese Laid-Open Patent Application 58-49609 is preferable, which is capable of fabricating a surface protective layer having carbon as the main component with excellent characteristics suitable for the surface protective layer for use in the present invention, since the method is a plasma CVD method, but has sputtering effects as well.

In the film formation method utilizing the plasma CVD method for fabricating a protective layer comprising carbon as the main component, it is unnecessary to heat the substrate for the protective layer, and a protective layer can be formed at a temperature as low as about 150° C. or less, so that this film formation method has the advantages over other film formation methods that there are no problems when a protective layer is formed on an organic photoconductive layer which has low heat resistance.

The thickness of such a protective layer comprising carbon as the main component can be controlled, for instance, by the length of the film formation time.

The composition of such a surface protective layer can be analyzed, for instance, by such measurement methods as XPS, AES, SIMS and the like.

Other features of this invention will become apparent in the course of the following description of exemplary embodiments, which are given for illustration of the invention and are not intended to be limiting thereof.

EXAMPLE 1

[Fabrication of Electrophotographic Photoconductor No. 1]

[Formation of Undercoat Layer]

A mixture of the following components was dispersed in a ball mall for 12 hours, whereby an undercoat layer formation liquid was prepared,

| | Parts by weight |
|---|---|
| $TiO_2$ (Trademark "Tipaque" made by Ishihara Sangyo Kaisha, Ltd.) | 1 |
| Polyamide resin (Trademark "CM8000" made by Toray Industries, Ltd.) | 1 |
| Methanol | 25 |

The thus prepared undercoat layer formation liquid was coated on a cylindrical aluminum support with an outer diameter of 80 mm and a length of 340 mm by an immersion coating method, and dried, whereby an undercoat layer with a thickness of about 2 μm was formed on the cylindrical aluminum support.

[Formation of Charge Generation Layer]

A mixture of the following components was dispersed in a ball mill for 72 hours:

| | Parts by Weight |
|---|---|
| Trisazo pigment of the following formula: | 30 |

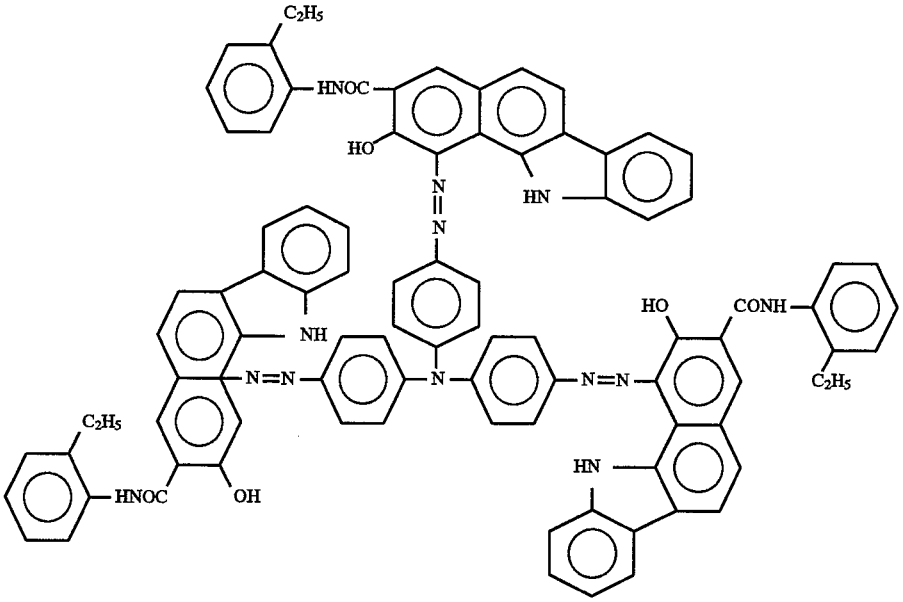

| | |
|---|---|
| Polyester resin (Trademark "Vylon 200" made by Toyobo Co., Ltd.) | 12 |
| Cyclohexanone | 360 |

The thus prepared liquid was diluted with 500 parts by weight of a mixed solvent of cyclohexanone and methyl ethyl ketone with a mixing ratio of 1:1 by weight, whereby a charge generation layer formation liquid was prepared.

The thus prepared charge generation layer formation liquid was coated on the undercoat layer and dried at 120° C. for 10 minutes, whereby a charge generation layer with a thickness of about 0.15 μm was formed on the undercoat layer.

[Formation of Charge Transport Layer]

A mixture of the following components was dispersed, whereby a charge transport layer formation liquid was prepared:

| | Parts by Weight |
|---|---|
| Charge transporting material of the following formula: | 10 |

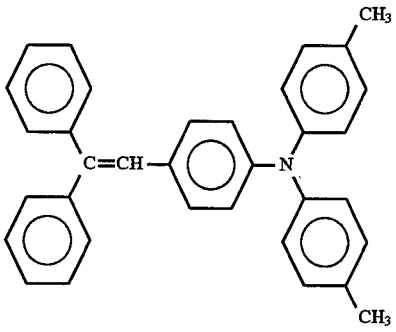

| | |
|---|---|
| Polycarbonate (Trademark "Panlite C-1400" made by Teijin Chemicals, Ltd.) | 10 |
| Tetrahydrofuran | 80 |

-continued

| | Parts by Weight |
|---|---|
| Silicone oil (Trademark "KF50" made by Sin-Etsu Chemical Co., Ltd.) | 0.001 |

The thus prepared charge transport layer formation liquid was coated on the charge generation layer, and dried, whereby a charge transport layer with a thickness of about 30 μm was formed on the charge generation layer.

Figure 5:
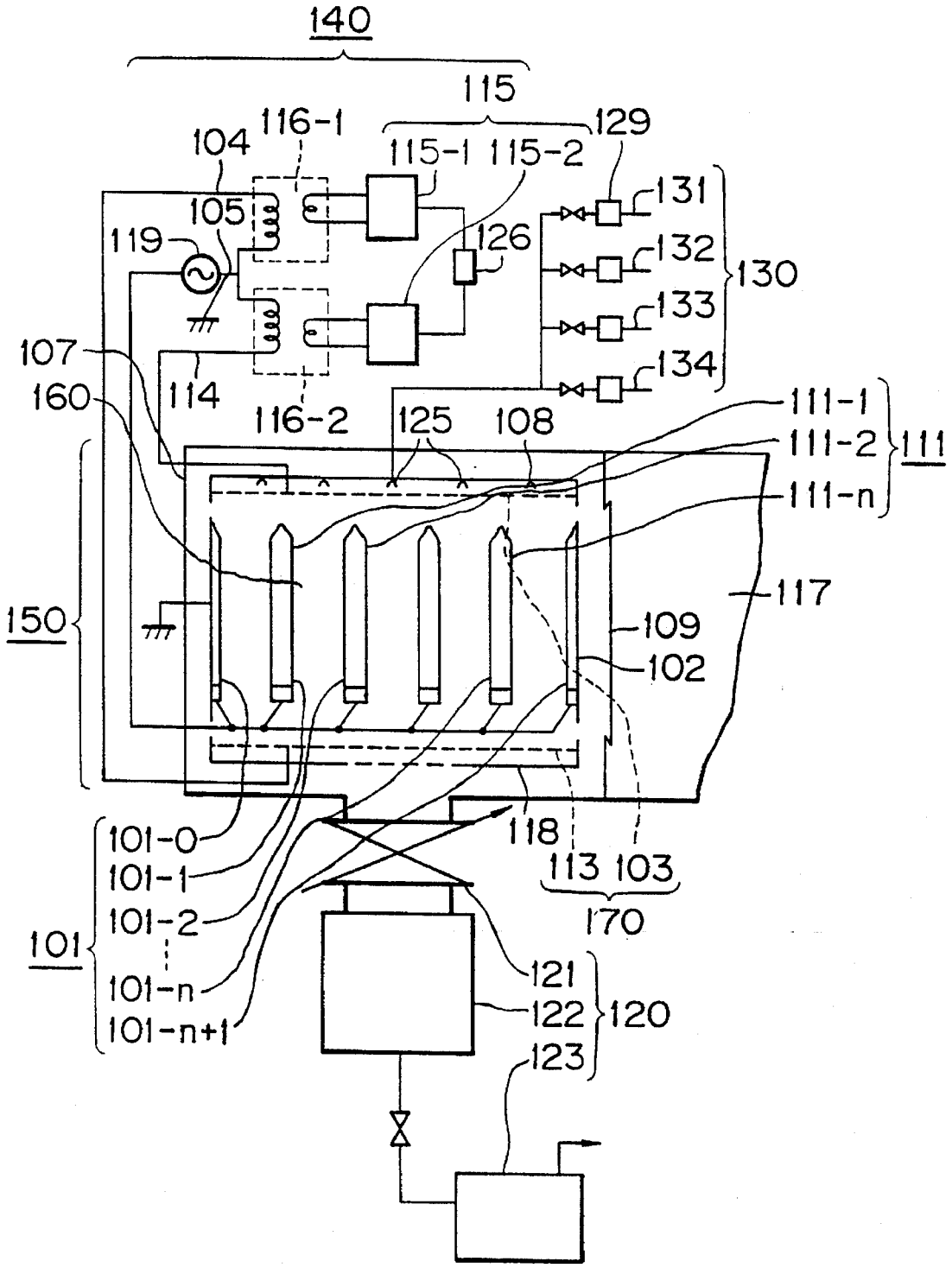
FIG. 5 is a block diagram of a specific example of a plasma CVD apparatus for fabrication of an electrophotographic photoconductor according to the present invention.
Figure 6:
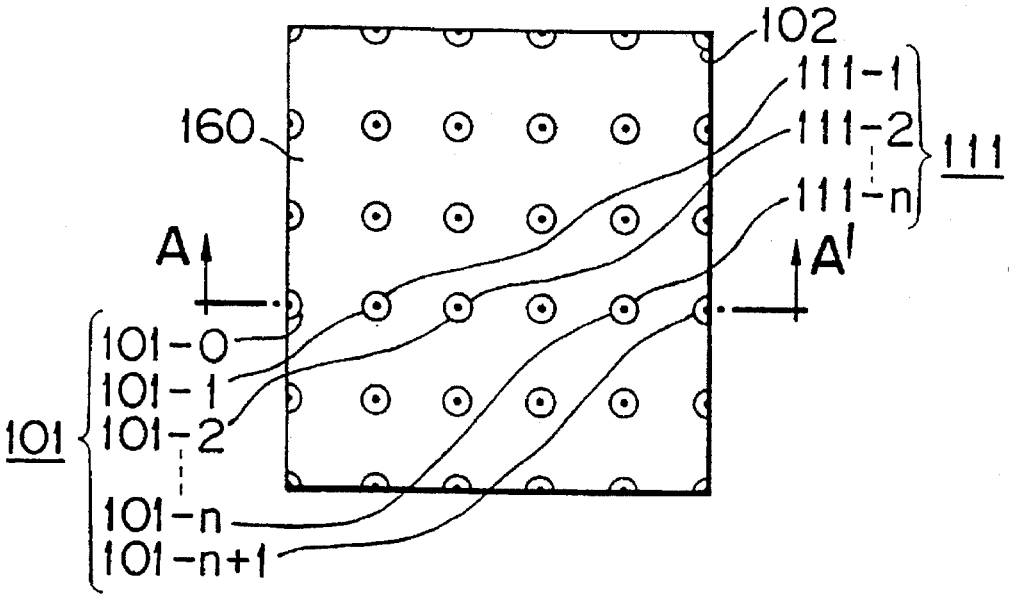
FIG. 6 is a plan view of an example of a frame structure for use in the plasma CVD apparatus shown in FIG. 5.
Figure 7:
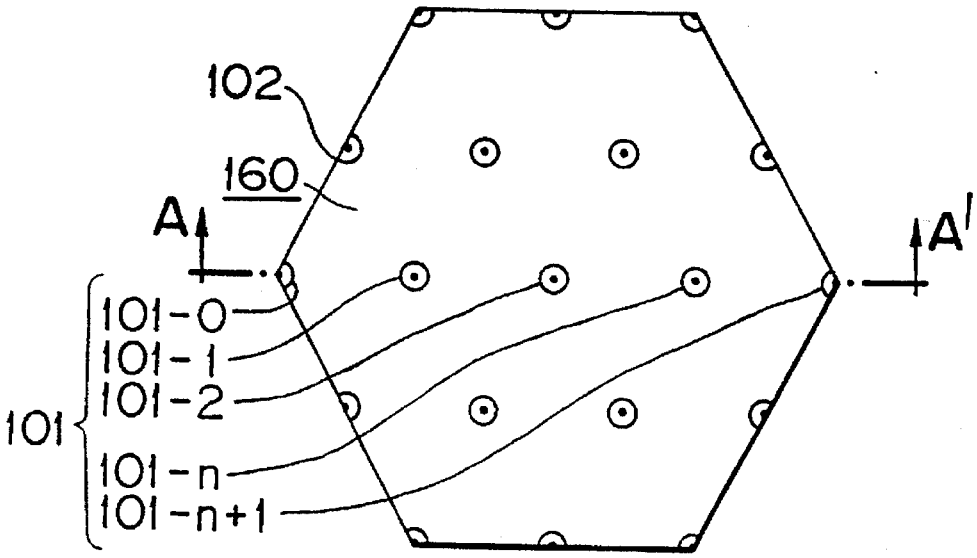
FIG. 7 is a plan view of another example of a frame structure for use in the plasma CVD apparatus shown in FIG. 5.

The thus fabricated photoconductor was mounted in such a plasma CVD apparatus as shown in FIGS. 5 to 7, whereby a surface protective layer comprising carbon as the main component was formed.

In FIG. 5, reference numeral 107 indicates a vacuum chamber of the plasma CVD apparatus, which is partitioned into preliminary loading and unloading chambers 117 by a gate valve 109. The vacuum chamber 107 is evacuated with an evacuation system 120 comprising a pressure adjustment valve 121, a turbo-molecular pump 122, and a rotary pump 123, and the pressure in the vacuum chamber 107 is maintained constant.

In the vacuum chamber 107, there is provided a reactor 150. The reactor 150 is constructed of a frame structure 102 which is square or hexagonal when viewed from the side of an electrode as shown in FIGS. 6 and 7, hoods 108, 118 which seal opening portions on the opposite ends thereof, and a pair of a first electrode 103 and a second electrode 113 made of a metal mesh, such as an aluminum mesh, in an identical shape, which are provided on the hoods 108 and 118.

Reference numeral 130 indicates gas lines for introducing gases into the reactor 150. To the gas lines, varieties of gas containers are connected. Various gases are introduced into the reactor 150 through the gas lines 130 via respective flow meters 129.

In the frame structure 102, supports 101 (101-1, 101-2, . . . , 101-n) with the above-mentioned photoconductive layer are disposed as shown in FIGS. 6 and 7.

Each of these supports is disposed as a third electrode as will be explained later in detail. A pair of power sources 115 (115-1, 115-2) is provided for applying a first A.C. voltage to the electrodes 103, 112. The frequency of the first A.C. voltage is in a range of 1 to 100 MHz. The power sources 115 (115-1, 115-2) are respectively connected to matching transformers 116-1, 116-2. The phases in these matching transformers are regulated by a phase regulator 126, so that the power can be supplied with a shaft of 180° or 0°. In other words, the power sources 115 (115-1, 115-2) can perform a symmetrical output or an in-phase output.

One end 104 of the matching transformer 116-1 and the other end 114 of the matching transformer 116-2 are respectively connected to the second electrodes 103, 113.

A mid-point 105 on the output side of the matching transformers 116-1, 116-2 is maintained at a ground level.

Furthermore, a power source 119 is provided between the mid-point 105 and a third electrode, that is, the supports 101 (101-1, 101-2, . . . , 101-n) or a holder 102 which is electrically connected to the supports 101, for applying a second A.C. voltage across the mid-point 105 an the third electrode.

The frequency of the second A.C. voltage is in the range of 1 to 500 KHz. The output of the first A.C. voltage applied to the first electrode and the second electrode is in a range of 0.1 to 1 KW when the frequency thereof is 13.56 MHz. The output of the second A.C. voltage applied to the third electrode, that is, the supports, is about 100 W when the frequency thereof is 150 KHz.

In this example, the surface protective layer was fabricated so as to be composed of a first protective layer in contact with the photoconductive layer, a second protective layer overlaid on the first protective layer, and a third protective layer overlaid on the second protective layer.

[Formation of First Protective Layer]

The first protective layer composed of a hydrogen-containing carbon was fabricated under the following film formation conditions:

| | |
|---|---|
| Flow rate of $CH_4$ | 200 sccm |
| Reaction pressure | 0.01 torr |
| First A.C. voltage output | 100 W 13.56 MHz |
| Bias voltage (D.C. current component) | −200 V |
| Thickness of first protective layer: | 1,200 Å |

The thus fabricated first protective layer was subjected to a composition analysis by the XPS method. The results of this analysis indicated that this first protective layer contained carbon, oxygen and hydrogen.

[Formation of Second Protective Layer]

The second protective layer composed of a hydrogen-containing carbon and nitrogen was fabricated under the following film formation conditioner:

| | |
|---|---|
| Flow rate of $CH_4$ | 90 sccm |
| Flow rate of $H_2$ | 210 sccm |
| Flow rate of $N_2$ | 45 sccm |
| Reaction pressure | 0.02 torr |
| First A.C. voltage output | 100 W 13.56 MHz |
| Bias voltage (D.C. current component) | −5 V |

-continued

| | |
|---|---|
| Thickness of second protective layer | 60,000 Å |

The thus fabricated second protective layer was subjected to a composition analysis by the XPS method. The results of this analysis indicated that the second protective layer contained carbon, oxygen, hydrogen and nitrogen, with the N/C ratio thereof being 0.15.

[Formation of Third Protective Layer]

The third protective layer composed of a 0hydrogen-containing carbon was fabricated under the following film formation conditions:

| | |
|---|---|
| Flow rate of $CH_4$ | 200 sccm |
| Reaction Pressure | 0.01 torr |
| First A.C. voltage output | 100 W 13.56 MHz |
| Bias voltage (D.C. current component) | −5 V |
| Thickness of third protective layer | 1,200 Å |

The thus fabricated third protective layer was subjected to a composition analysis by the XPS method. The results of this analysis indicated that the third protective layer contained carbon, oxygen and hydrogen.

Thus, an electrophotographic photoconductor No. 1 of the present invention was fabricated.

The thus fabricated electrophotographic photoconductor No. 1 was incorporated in a commercially available digital copying machine (Trademark "Imagio 420 V" made by Ricoh Company, Ltd.) and was subjected to evaluation tests by making 500,000 copies, thereby measuring the initial electrophotographic photosensitivity thereof and inspecting the peeled state of the surface protective layer from the photoconductive layer thereof and the scratched state at the surface of the electrophotographic photoconductor No. 1 after the making of 500,000 copies. The results are shown in TABLE 1.

EXAMPLE 2

[Fabrication of Electrophotographic Photoconductor No. 2]

The procedure for the fabrication of the electrophotographic photoconductor No. 1 in Example 1 was repeated except that the film formation conditions for the first protective layer in Example 1 were changed as follows, whereby an electrophotographic photoconductor No. 2 of the present invention was fabricated:

| | |
|---|---|
| Flow rate of $CH_4$ | 200 sccm |
| Flow rate of $N_2$ | 5 sccm |
| Reaction pressure | 0.01 torr |
| First A.C. voltage output | 100 W 13.56 MHz |
| Bias voltage (D.C. current component) | −200 V |
| Thickness of first protective layer | 1,200 Å |

The thus fabricated first protective layer was subjected to a composition analysis by the XPS method. The results of this analysis indicated that the first protective layer contained carbon, oxygen, hydrogen and nitrogen, with the N/C ratio thereof being 0.002.

The thus fabricated electrophotographic photoconductor No. 2 of the present invention was subjected to the same evaluation tests as in Example 1. The results are shown in TABLE 1.

EXAMPLE 3

[Fabrication of Electrophotographic Photoconductor No. 3]

The procedure for the fabrication of the electrophotographic photoconductor No. 1 in Example 1 was repeated except that the film formation conditions for the third protective layer in Example 1 were changed as follows, whereby an electrophotographic photoconductor No. 3 of the present invention was fabricated:

| | |
|---|---|
| Flow rate of $CH_4$ | 200 sccm |
| Flow rate of $N_2$ | 5 sccm |
| Reaction pressure | 0.01 torr |
| First A.C. voltage output | 100 W 13.56 MHz |
| Bias voltage (D.C. current component) | −200 V |
| Thickness of third protective layer | 1,500 Å |

The thus fabricated third protective layer was subjected to a composition analysis by the XPS method. The results of this analysis indicated that the third protective layer contained carbon, oxygen, hydrogen and nitrogen, with the N/C ratio thereof being 0.002.

The thus fabricated electrophotographic photoconductor No. 3 of the present invention was subjected to the same evaluation tests as in Example 1. The results are shown in TABLE 1.

EXAMPLE 4

[Fabrication of Electrophotographic Photoconductor No. 4]

The procedure for the fabrication of the electrophotographic photoconductor No. 1 in Example 1 was repeated except that the film formation conditions for the second protective layer in Example 1 were changed as follows, whereby an electrophotographic photoconductor No. 4 of the present invention was fabricated:

| | |
|---|---|
| Flow rate of $CH_4$ | 90 sccm |
| Flow rate of $H_2$ | 210 sccm |
| Flow rate of $N_2$ | 20 sccm |
| Reaction pressure | 0.01 torr |
| First A.C. voltage output | 100 W 13.56 MHz |
| Bias voltage (D.C. current component) | −200 V |
| Thickness of second protective layer | 1,500 Å |

The thus fabricated second protective layer was subjected to a composition analysis by the XPS method. The results of this analysis indicated that the second protective layer contained carbon, oxygen, hydrogen and nitrogen, with the N/C ratio thereof being 0.02.

The thus fabricated electrophotographic photoconductor No. 4 of the present invention was subjected to the same evaluation tests as in Example 1. The results are shown in TABLE 1.

EXAMPLE 5

[Fabrication of Electrophotographic Photoconductor No. 5]

The procedure for the fabrication of the electrophotographic photoconductor No. 1 in Example 1 was repeated except that the film formation conditions for the third protective layer in Example 1 were changed as follows, whereby an electrophotographic photoconductor No. 5 of the present invention was fabricated:

| | |
|---|---|
| Flow rate of $CH_4$ | 200 sccm |
| Flow rate of $N_2$ | 40 sccm |
| Reaction pressure | 0.01 torr |
| First A.C. voltage output | 100 W 13.56 MHz |
| Bias voltage (D.C. current component) | −50 V |

The thus fabricated third protective layer was subjected to a composition analysis by the XPS method. The results of this analysis indicated that the third protective layer contained carbon, oxygen, hydrogen and nitrogen, with the N/C ratio thereof being 0.02.

The thus fabricated electrophotographic photoconductor No. 5 of the present invention was subjected to the same evaluation tests as in Example 1. The results are shown in TABLE 1.

EXAMPLE 6

[Fabrication of Electrophotographic Photoconductor No. 6]

The procedure for the fabrication of the electrophotographic photoconductor No. 1 in Example 1 was repeated except that the film formation conditions for the first protective layer in Example 1 were changed as follows, whereby an electrophotographic photoconductor No. 6 of the present invention was fabricated:

| | |
|---|---|
| Flow rate of $CH_4$ | 200 sccm |
| Flow rate of $N_2$ | 40 sccm |
| Reaction pressure | 0.03 torr |
| First A.C. voltage output | 100 W 13.56 MHz |
| Bias voltage (D.C. current component) | −50 V |

The thus fabricated fire protective layer was subjected to a composition analysis by the XPS method. The results of this analysis indicated that the first protective layer contained carbon, oxygen, hydrogen and nitrogen, with the N/C ratio thereof being 0.02.

The thus fabricated electrophotographic photoconductor No. 6 of the present invention was subjected to the same evaluation tests as in Example 1. The results are shown in TABLE 1.

EXAMPLE 7

[Fabrication of Electrophotographic Photoconductor No. 7]

The procedure for the fabrication of the electrophotographic photoconductor No. 1 in Example 1 was repeated except that the film formation conditions for the first, second and third protective layers in Example 1 were respectively changed as follows, whereby an electrophotographic photoconductor No. 7 of the present invention was fabricated:

[Formation of First Protective Layer]

The first protective layer composed of a hydrogen-containing amorphous was fabricated under the following film formation conditions:

| | |
|---|---|
| Flow rate of $CH_4$ | 200 sccm |
| Reaction pressure | 0.01 torr |
| First A.C. voltage output | 100 W 13.56 MHz |
| Bias voltage (D.C. current component) | −200 V |
| Thickness of second protective layer | 1,500 Å |

The thus fabricated first protective layer was subjected to a composition analysis by the XPS method. The results of this analysis indicated that this first protective layer contained carbon, oxygen and hydrogen.

[Formation of Second Protective Layer]

The second protective layer composed of a hydrogen-containing amorphous carbon and nitrogen was fabricated under the following film formation conditions:

| | |
|---|---|
| Flow rate of $CH_4$ | 90 sccm |
| Flow rate of $H_2$ | 210 sccm |
| Flow rate of $C_2F_6$ | 25 sccm |
| Reaction pressure | 0.02 torr |
| First A.C. voltage output | 100 W 13.56 MHz |
| Bias voltage (D.C. current component) | −100 V |
| Thickness of second protective layer | 20,000 Å |

The thus fabricated second protective layer was subjected to a composition analysis by the XPS method. The results of this analysis indicated that the second protective layer contained carbon, oxygen, hydrogen and fluorine, with the F/C ratio thereof being 0.008.

[Formation of Third Protective Layer]

The third protective layer composed of a hydrogen-containing amorphous carbon was fabricated under the following film formation conditions:

| | |
|---|---|
| Flow rate of $CH_4$ | 200 sccm |
| Reaction pressure | 0.01 torr |
| First A.C. voltage output | 100 W 13.56 MHz. |
| Bias voltage (D.C. current component) | −200 V |
| Thickness of third protective layer | 1,500 Å |

The thus fabricated third protective layer was subjected to a composition analysis by the XPS method. The results of this analysis indicated that the third protective layer contained carbon, oxygen and hydrogen.

Thus, an electrophotographic photoconductor No. 7 of the present invention was fabricated.

The thus fabricated electrophotographic photoconductor No. 7 of the present invention was subjected to the same evaluation tests as in Example 1. The results are shown in TABLE 1.

Comparative Example 1

[Fabrication of Comparative Electrophotographic Photoconductor No. 1]

The procedure for the fabrication of the electrophotographic photoconductor No. 1 An Example 1 was repeated except the third protective layer provided in Example 1 was not provided, whereby a comparative electrophotographic photoconductor No. 1 was fabricated.

The thus fabricated comparative electrophotographic photoconductor No. 1 was subjected to the same evaluation tests as in Example 1. The results are shown in TABLE 1.

COMPARATIVE EXAMPLE 2

[Fabrication of Comparative Electrophotographic Photoconductor No. 2]

The procedure for the fabrication of the electrophotographic photoconductor No. 1 in Example 1 was repeated except the first protective layer provided in Example 1 was not provided, whereby a comparative electrophotographic photoconductor No. 2 was fabricated.

The thus fabricated comparative electrophotographic photoconductor No. 2 was subjected to the same evaluation tests as in Example 1. The results are shown in TABLE 1.

EXAMPLE 8

[Fabrication of Electrophotographic Photoconductor No. 8]

The procedure for the fabrication of the electrophotographic photoconductor No. 1 in Example 1 was repeated except that the film formation conditions for the second protective layer in Example 1 were changed as follows, whereby an electrophotographic photoconductor No. 8 of the present invention was fabricated:

| | |
|---|---|
| Flow rate of $C_2H_4$ | 90 sccm |
| Flow rate of $H_2$ | 210 sccm |
| Flow rate of $B_2H_6$ | 30 sccm |
| Flow rate of $NH_3$ | 15 sccm |
| Reaction pressure | 0.02 torr |
| First A.C. voltage output | 5 W 13.56 MHz |
| Bias voltage (D.C. current component) | −5 V |

The thus fabricated second protective layer was subjected to a composition analysis by the XPS method. The results of this analysis indicated that the second protective layer contained carbon, oxygen, hydrogen, nitrogen and boron.

The thus fabricated electrophotographic photoconductor No. 8 of the present invention was subjected to the same evaluation tests as in Example 1. The results are shown in TABLE 1.

TABLE 1

| | At initial stage Photo-sensitivity *1 (lux · sec) | After the making of 500,000 copies: Peeled state *2 | After the making of 500,000 copies: Peeled state *3 |
|---|---|---|---|
| Ex. 1 | 2.10 | o | o |
| Ex. 2 | 2.08 | o | o |
| Ex. 3 | 2.12 | o | o |
| Ex. 4 | 2.45 | o | o |
| Ex. 5 | 2.12 | o | x |
| Ex. 6 | 2.13 | Δ | o |
| Ex. 7 | 2.06 | o | o |
| Ex. 8 | 1.81 | o | o |
| Comp. Ex. 1 | 2.08 | x | Δ |
| Comp. Ex. 2 | Unmeasureable *4 | o | o |

TABLE 1-continued

| At initial stage Photo- sensitivity *1 (lux · sec) | After the making of 500,000 copies Peeled state *2 | Peeled state *3 |
|---|---|---|

Photosensitivity *1: The photoconductor was charged by corona charging to an initial surface potential of 800 V and was then exposed to light until the surface potential thereof was decreased to a surface potential of 160 V, which was 1/5 the initial surface potential, so that the time (seconds) required for this reduction of the surface potential was measured. Then the photosensitivity ($E_{1/5}$) of each electrophotographic photoconductor was calculated.
Peeled State *2:
o: No peeling of the surface protective layer was observed on the surface of the photoconductive layer.
Δ: Minute peeling of the surface protective layer was locally observed on the surface of the photoconductive layer.
x: Peeling of the surface protective layer was observed on the entire surface of the photoconductive layer.
Scratched State *3:
o: No scratches were observed on the surface of the photoconductor.
Δ: Minute scratches were locally observed on the surface of the photoconductor.
x: Scratches were observed on the entire surface of the photoconductor.
Unmeasurable *4: The residual potential was too high to be measured.

EXAMPLE 9

[Fabrication of Electrophotographic Photoconductor No. 9]

The procedure for the fabrication of the electrophotographic photoconductor No. 1 in Example 1 was repeated except that the film formation conditions for the first, second and third protective layers in Example 1 were respectively changed as follows, whereby an electrophotographic photoconductor No. 9 of the present invention was fabricated:

[Formation of First Protective Layer]

The first protective layer was fabricated under the following film formation conditions:

| | |
|---|---|
| Flow rate of $C_2H_4$ | 90 sccm |
| Reaction pressure | 0.01 torr |
| First A.C. voltage output | 100 W 13.56 MHz |
| Bias voltage (D.C. current component) | −250 V |
| Thickness of second protective layer | 400 Å |

[Formation of Second Protective Layer]

The second protective layer was fabricated under the following film formation conditions:

| | |
|---|---|
| Flow rate of $C_2H_4$ | 90 sccm |
| Flow rate of $H_2$ | 210 sccm |
| Flow rate of $NF_3$ | 45 sccm |
| Reaction pressure | 0.03 torr |
| First A.C. voltage output | 100 W 13.56 MHz |
| Bias voltage (D.C. current component) | −5 V |
| Thickness of second protective layer | 22,000 Å |

[Formation of Third Protective Layer]

The third protective layer was fabricated under the following film formation conditions:

| | |
|---|---|
| Flow rate of $C_2H_4$ | 90 sccm |
| Reaction pressure | 0.01 torr |
| First A.C. voltage output | 100 W 13.56 MHz |
| Bias voltage (D.C. current component) | −250 V |
| Thickness of third protective layer | 300 Å |

The thus fabricated electrophotographic photoconductor No. 9 was incorporated in a commercially available digital copying machine (Trademark "Imagio 420 V" made by Ricoh Company, Ltd.) and was subjected to evaluation tests by making 600,000 copies, thereby measuring the electrophotographic photosensitivity at the initial copy making step, and inspecting the respective peeled states of the surface protective layer from the photoconductive layer of the electrophotographic photoconductor No. 9 after the making of 500,000 copies, 550,000 copies and 600,000 copies. The results are shown in TABLE 2.

EXAMPLE 10

[Fabrication of Electrophotographic Photoconductor No. 10]

The procedure for the fabrication of the electrophotographic photoconductor No. 9 in Example 9 was repeated except that an interface intermediate layer portion with a thickness of 400 Å, which was included in the second protective layer, was formed between the first protective layer and the second protective layer during the formation thereof by gradually changing the film formation conditions in the course of the formation of the interface intermediate layer, whereby an electrophotographic photoconductor No. 10 of the present invention was fabricated.

The thus formed interface intermediate layer was subjected to a depth profile inspection by use of XPS, RBS and ERDA, whereby it was confirmed that the atomic N/C ratio in the interface intermediate layer was gradually changed from 0.002 to 0.15 in the direction from the first protective layer toward the second protective layer.

The electrophotographic photoconductor No. 10 of the present invention was evaluated in the same manner as in Example 9, with respect to the initial electrophotographic photosensitivity and the peeled states of the surface protective layer after the making of 500,000 copies, 550,000 copies and 600,000 copies. The results are shown in TABLE 2.

EXAMPLE 11

[Fabrication of Electrophotographic Photoconductor No. 11]

The procedure for the fabrication of the electrophotographic photoconductor No. 9 in Example 9 was repeated except that an interface intermediate layer portion with a thickness of 6,000 Å, which was included in the second protective layer, was formed between the first protective layer and the second protective layer during the formation thereof by gradually changing the film formation conditions in the course of the formation of the interface intermediate layer, whereby an electrophotographic photoconductor No. 11 of the present invention was fabricated.

The thus formed interface intermediate layer was subjected to a depth profile inspection by use of XPS, RBS and ERDA, whereby it was confirmed that the atomic N/C ratio in the interface intermediate layer gradually changed from 0.002 to 0.15 in the direction from the first protective layer toward the second protective layer.

The electrophotographic photoconductor No. 11 of the present invention was evaluated in the same manner as in Example 9, with respect to the initial electrophotographic photosensitivity and the peeled states of the surface protective layer after the making of 500,000 copies, 550,000 copies and 600,000 copies, The results are shown in TABLE 2.

EXAMPLE 12

[Fabrication of Electrophotographic Photoconductor No. 12]

The procedure for the fabrication of the electrophotographic photoconductor No. 9 in Example 9 was repeated except that an interface intermediate layer portion with a thickness of 12,000 Å, which was included in the second protective layer, was formed between the first protective layer and the second protective layer during the formation thereof by gradually changing the film formation conditions in the course of the formation of the interface intermediate layer, whereby an electrophotographic photoconductor No. 12 of the present invention was fabricated.

The thus formed interface intermediate layer was subjected to a depth profile inspection by use of XPS, RBS and ERDA, whereby it was confirmed that the atomic N/C ratio in the interface intermediate layer gradually changed from 0.002 to 0.15 in the direction from the first protective layer toward the second protective layer.

The electrophotographic photoconductor No. 12 of the present invention was evaluated in the same manner as in Example 9, with respect to the initial electrophotographic photosensitivity and the peeled states of the surface protective layer after the making of 500,000 copies, 550,000 copies and 600,000 copies. The results are shown in TABLE 2.

EXAMPLE 13

[Fabrication of Electrophotographic Photoconductor No. 13]

The procedure for the fabrication of the electrophotographic photoconductor No. 9 in Example 9 was repeated except that an interface intermediate layer portion with a thickness of 400 Å, which was included in the second protective layer, was formed between the second protective layer and the third protective layer during the formation thereof by gradually changing the film formation conditions in the course of the formation of the interface intermediate layer, whereby an electrophotographic photoconductor No. 13 of the present invention was fabricated.

The thus formed interface intermediate layer was subjected to a depth profile inspection by use of XPS, RBS and ERDA, whereby it was confirmed that the atomic N/C ratio in the interface intermediate layer gradually changed from 0.15 to 0.002 in the direction from the second protective layer toward the third protective layer.

The electrophotographic photoconductor No. 13 of the present invention was evaluated In the same manner as in Example 9, with respect to the initial electrophotographic photosensitivity and the peeled states of the surface protective layer after the making of 500,000 copies, 550,000 copies and 600,000 copies. The results are shown in TABLE 2.

EXAMPLE 14

[Fabrication of Electrophotographic Photoconductor No. 14]

The procedure for the fabrication of the electrophotographic photoconductor No. 9 in Example 9 was repeated except that an interface intermediate layer portion with a thickness of 5,000 Å, which was included in the second protective layer, was formed between the second protective layer and the third protective layer during the formation thereof by gradually changing film formation conditions in the course of the formation of the interface intermediate layer, whereby an electrophotographic photoconductor No. 14 of the present invention was fabricated.

The thus formed interface intermediate layer was subjected to a depth profile inspection by use of XPS, RBS and ERDA, whereby it was confirmed that the atomic N/C ratio in the interface intermediate layer gradually changed from 0.15 to 0.002 in the direction from the second protective layer toward the third protective layer.

The electrophotographic photoconductor No. 14 of the present invention was evaluated in the same manner as in Example 9, with respect to the initial electrophotographic photosensitivity and the peeled states of the surface protective layer after the making of 500,000 copies, 550,000 copies and 600,000 copies. The results are shown in TABLE 2.

EXAMPLE 15

[Fabrication of Electrophotographic Photoconductor No. 15]

The procedure for the fabrication of the electrophotographic photoconductor No. 9 in Example 9 was repeated except that an interface intermediate layer portion with a thickness of 12,000 Å, which was included in the second protective layer, was formed between the second protective layer and the third protective layer during the formation thereof by gradually changing the film formation conditions in the course of the formation of the interface intermediate layer, whereby an electrophotographic photoconductor No. 15 of the present invention was fabricated.

The thus formed interface intermediate layer was subjected to a depth profile inspection by use of XPS, RBS and ERDA, whereby it was confirmed that the atomic N/C ratio in the interface intermediate layer gradually changed from 0.15 to 0.002 in the direction from the second protective layer toward the third protective layer.

The electrophotographic photoconductor No. 15 of the present invention was evaluated in the same manner as in Example 9, with respect to the initial electrophotographic photosensitivity and the peeled states of the surface protective layer after the making of 500,000 copies, 550,000 copies and 600,000 copies. The results are shown in TABLE 2.

TABLE 2

| | At Initial Stage Photosensitivity *1 | After making 500,000 copies Scratched States *2 | After making 550,000 copies Scratched States *2 | After making 600,000 copies Scratched States *2 |
|---|---|---|---|---|
| Ex. 9 | 1.56 | ○ | Δ | x |
| Ex. 10 | 1.57 | ○ | ○ | Δ |
| Ex. 11 | 1.59 | ○ | ○ | ○ |
| Ex. 12 | 1.71 | ○ | ○ | ○ |

TABLE 2-continued

| | At Initial Stage Photosensitivity *1 | After making 500,000 copies Scratched States *2 | After making 550,000 copies Scratched States *2 | After making 600,000 copies Scratched States *2 |
|---|---|---|---|---|
| Ex. 13 | 1.51 | o | o | Δ |
| Ex. 14 | 1.53 | o | o | o |
| Ex. 15 | 1.69 | o | o | o |

Photosensitivity *1: The photoconductor was charged by corona charging to an initial surface potential of 800 V and was then exposed to light until the surface potential thereof was decreased to a surface potential of 160 V, which was 1/5 the initial surface potential, so that the time (seconds) required for this reduction of the surface potential was measured. Then the photosensitivity ($E_{1/5}$) of each electrophotographic photoconductor was calculated.
Scratched state *2:
o: No scratches were observed on the surface of the photoconductor.
Δ: Minute scratches were locally observed on the surface of the photoconductor.
x: Scratches were observed on the entire surface of the photoconductor.

Japanese Patent Application No. 06-013201 filed Jan. 11, 1994, and Japanese Patent Application filed Nov. 11, 1994 (Application No. not available yet) are hereby incorporated by reference.

What is claimed:

1. An electrophotographic photoconductor comprising:

an electroconductive support;

a photoconductive layer formed on said electroconductive support; and a surface protective layer formed on said photoconductive layer, said surface protective layer having a hydrogen-containing diamond-like carbon structure or amorphous carbon structure, which comprises at least one additive element selected from the group consisting of nitrogen, fluorine, boron, phosphorus, chlorine, bromine and iodine, with the atomic ratio of said additive element to said carbon in said carbon structure having such a distribution in the direction of the thickness of said surface protective layer that said atomic ratio is smaller in the vicinity of the top surface of said surface protective layer and in the vicinity of said photoconductive layer adjacent to said surface protective layer than in the other portion of said surface protective layer.

2. An electrophotographic photoconductor comprising:

an electroconductive support;

a photoconductive layer formed on said electroconductive support; and a surface protective layer formed on said photoconductive layer, said surface protective layer having a hydrogen-containing diamond-like carbon structure or amorphous carbon structure, which comprises nitrogen with the atomic ratio thereof to said carbon in said carbon structure having such a distribution in the direction of the thickness of said surface protective layer that said atomic ratio is 0.005 or less in the vicinity of the top surface of said surface protective layer and in the vicinity of said photoconductive layer adjacent to said surface protective layer, and 0.05 or more in the other portion of said surface protective layer.

* * * * *

UNITED STATES PATENT AND TRADEMARK OFFICE

CERTIFICATE OF CORRECTION

PATENT NO. : 5,656,406

DATED : AUGUST 12, 1997

INVENTOR(S) : HIROSHI IKUNO ET AL

It is certified that error appears in the above-identified patent and that said Letters Patent is hereby corrected as shown below:

Column 1, line 47, "process As" should read --process is--.

Column 2, line 16, "a-Si later" should read --a-Si layer--.

Column 3, line 27, "supports" should read --support;--.
line 38, "photoconduc-tive" should read --photoconductive--.

Column 5, line 19, "As of the same" should read --is of the same--.

Column 9, line 44, "radio" should read --ratio--.

Column 10, line 46, "mall" should read --mill--.
line 47, "prepared," should read --prepared:--.

Column 13, line 12, "shaft" should read --shift--;
line 24, "an the third" should read --and the third--.

Column 14, line 12, "0hydrogen-" should read --hydrogen--.

Column 16, line 43, "fire" should read --first--.

UNITED STATES PATENT AND TRADEMARK OFFICE

CERTIFICATE OF CORRECTION

PATENT NO. : 5,656,406

DATED : AUGUST 12, 1997

INVENTOR(S) : HIROSHI IKUNO ET AL

It is certified that error appears in the above-identified patent and that said Letters Patent is hereby corrected as shown below:

Column 17, line 64, "An Example 1" should read --in Example 1--.

Column 21, line 9, "600,000 copies," should read --600,000 copies.--.

line 62, "evaluated In the" should read --evaluated in the--.

Signed and Sealed this

Twenty-first Day of July, 1998

Bruce Lehman

*Attest:*

BRUCE LEHMAN

*Attesting Officer*

*Commissioner of Patents and Trademarks*